United States Patent [19]

Milman et al.

[11] 3,945,427

[45] Mar. 23, 1976

[54] INSTALLATION FOR PRODUCING BIMETALLIC SOLID BODIES OF CYLINDRICAL SHAPE

[76] Inventors: Boris Samoilovich Milman, Sharikopodshipnikovskaya ulitsa, 2, kv. 89; Genrikh Sergeevich Mirzoian, ulitsa Flotskaya, 7, korpus 5, kv. 809; Gennady Sergeevich Strizhov, Uohebny porculok, 2, kv. 101; Viktor Gurievich Tinyakov, I Juzhno-portovy prodva, 16/39, kv. 23, all of Moscow; Pavel Petrovich Doroschenko, prospekt Lenine, 122, kv. 16, Lutugino, Voroshilovgradskaya oblast; Vladimir Evgenievich Karssky, ulitsa Krasnykh partizan, 2, Lutugino, Voroehflovgradskaya oblast; Moisei Markovich Levin, Sharikopodshipnikovskaya ulitsa, 2, kv. 4, Moscow; Viktor Mikhailovich Krapukhin, Suvorovsky bulvar, 15, kv. 13, Moscow; Pavel Vladimirovich Semenov, 3 Frunzenskaya ulitsa, 9, kv. 155, Moscow, all of U.S.S.R.

[22] Filed: Apr. 19, 1974

[21] Appl. No.: 463,046

Related U.S. Application Data

[63] Continuation of Ser. No. 397,411, Sept. 14, 1973, abandoned, which is a continuation of Ser. No. 310,795, Nov. 30, 1972, abandoned, which is a continuation of Ser. No. 153,932, June 17, 1971, abandoned.

[52] U.S. Cl. ..... 164/298; 164/136; 164/335; 164/348

[51] Int. Cl.[2] ..... B22D 13/02

[58] Field of Search ..... 164/114, 175, 292, 298, 164/299, 286, 316–318, 335, 348, 136; 425/435

[56] References Cited

UNITED STATES PATENTS

| | | | |
|---|---|---|---|
| 1,321,457 | 11/1919 | Kralund | 164/348 |
| 1,470,755 | 10/1923 | Lane | 164/318 |
| 1,620,829 | 3/1927 | Moore et al. | 164/299 X |
| 2,266,972 | 12/1941 | Holmquist | 164/114 X |
| 3,412,785 | 11/1968 | Lorang | 164/298 |

FOREIGN PATENTS OR APPLICATIONS

| | | | |
|---|---|---|---|
| 22,567 | 9/1968 | Japan | 164/114 |

*Primary Examiner*—R. Spencer Annear
*Attorney, Agent, or Firm*—Holman & Stern

[57] ABSTRACT

An installation for producing bimetallic solid bodies of cylindrical shape comprises a movable base which, together with a runner means is adapted to eliminate a clearance between the runner means and a casting mould having a stationary horizontal axis of rotation.

3 Claims, 3 Drawing Figures

INSTALLATION FOR PRODUCING BIMETALLIC SOLID BODIES OF CYLINDRICAL SHAPE

This is a continuation, of application Ser. No. 397,411, filed Sept. 14, 1973 which in turn is a continuation of Ser. No. 310,795 filed Nov. 30, 1972, which in turn is a continuation of Ser. No. 153,932 filed June 17, 1971, all of which are now abandoned.

BACKGROUND OF THE INVENTION

The present invention relates to the art of foundry, and more specifically to an installation for producing bimetallic solid bodies of cylindrical shape by pouring molten metals into a rotary casting mould.

The most successful use of the invention can be made in the production of mill rolls featuring high hardness and wear resistance.

No less advantageously can this invention be employed for making flour milling rolls, rolls for the chemical, paint and lacquer, and other industries.

Most generally used in installations for manufacturing hollow bimetallic bodies of cylindrical shape are casting molds having a horizontal axis of rotation. Production of solid bodies involves a problem of preventing the outflow of fluid metal from the casting mould when the central zone of the mould is being filled by the fluid metal.

Known in the art are attempts to seal the clearance between the casting mould and an immovable runner means adjoining it, by means of a gland filled with fluid lead and mounted at the end of the mould. (see, for example Soviet journal "Litsynoyo Delo" No. 10, 1934).

However, these attempts were unsuccessful due to the difficulty of supplying fluid lead into a rotating gland.

Also known are attempts related to the method of pouring a first metal into the mould rotating about its horizontal axis, a second metal being poured into the casting mould only after mounting it in a vertical position (see, for example, Japanese Pat. Nos. 35-5618 dated 1960, and No. 39-11205 dated 1964).

However, when pouring metal into a vertically disposed mould, there emerge difficulties connected with the retention of a layer of flux intended to protect the surface of the first metal layer against oxidation, as well as difficulties connected with the observed nonuniform distribution of temperature throughout the depth of the mould. Yet the uniform distribution of both the flux layer and temperature are the decisive conditions affecting the structural uniformity, density, and reliability of the joint of metals. Also, the installation turns out to be rather complex, which is due to the need for shifting the casting mould from a horizontal into a vertical position and back within extremely small time intervals determined by the heat transfer conditions. This problem is most acute for installations intended to produce large castings.

Another problem connected with the casting mould whose position must be changed before pouring the second metal, consists in the need to have a head, the weight of which exceeds the weight of metal of the casting by a factor of 1.5–2.0 times.

SUMMARY OF THE INVENTION

It is an object of the present invention to eliminate the aforedescribed difficulties.

The basic object of the invention is to provide an installation for producing cylindrical-shaped bimetallic solid bodies, having a casting mould with a stationary horizontal axis of rotation, and in which a clearance between a runner means and the mould is eliminated, at the same time the contact joint therebetween having no gland.

According to the invention, this is achieved by providing the outlet end of the runner means with a tapered shape, and the walls of the inlet hole in the casting mould with a shape congruent with that of said outlet end of the runner means. The runner means is mounted on a base adapted to displace said outlet end along the axis of rotation of the casting mould. Said base is adapted to tightly press the outlet end of the runner means against the walls of the inlet hole in the casting mould. In the end of the casting mould opposite to the end with the inlet hole, there is provided a hole for exhausting gases.

With such a design of the installation, which is simple enough, the outflow of fluid metal from the casting mould rotating about a horizontal axis is completely prevented as the metal fills the central zone of the mould.

In the preferred embodiment of the installation according to the invention, the base whereon the runner means is mounted is preferably made to pivot in the horizontal plane. In addition, the pivot of the base should be creased by a perpendicular erected from a point on the axis of rotation of the casting mould, which is located in the middle of that section of the inlet hole of the mould wherein the walls of the inlet hole contact the outlet end of the runner means.

If the distance between said point and the pivot of the base is long enough, the outlet end of the runner means will move approximately along the axis of rotation of the casting mould at the time when it contacts the walls of the inlet hole of the casting mould. And at the same time, the introduction and retraction of this end resulting from base pivoting will occur comparatively quickly.

It is also preferable to mount on a fixed basement near the casting mould a hydraulic power cylinder, and to provide on the pivoting base a means for connection of the base with said cylinder after the outlet end of the runner means enters the inlet hole of the casting mould. In this case the cylinder tightly presses said outlet end to the walls of said inlet hole.

These measures are aimed at preventing the formation of a clearance between the runner and the mould as metal is poured into the latter.

The zone of contact of the outlet end of the runner means with the walls of the mould inlet hole is intensely water-cooled by means of a sprayer.

After the mould is filled, in the runner channel and in the hole of the mould a plug of solidified metal is formed, which subsequently prevents the outlet of fluid metal from the central zone of the mould and from the runner.

An essential advantage of the invention resides in the fact that the consumption of metal is reduced not less than 1.5-2.0 times as compared to installation with tiltable casting moulds, and at the same time a tight and secure joint of the two alloy layers is obtained.

Brief DESCRIPTION OF THE DRAWINGS

Following is a detailed description of a preferred embodiment of the installation according to the invention with references to the appended drawings, wherein.

DETAILED DESCRIPTION OF THE PREFERRED EMBODIMENT

Figure 1:
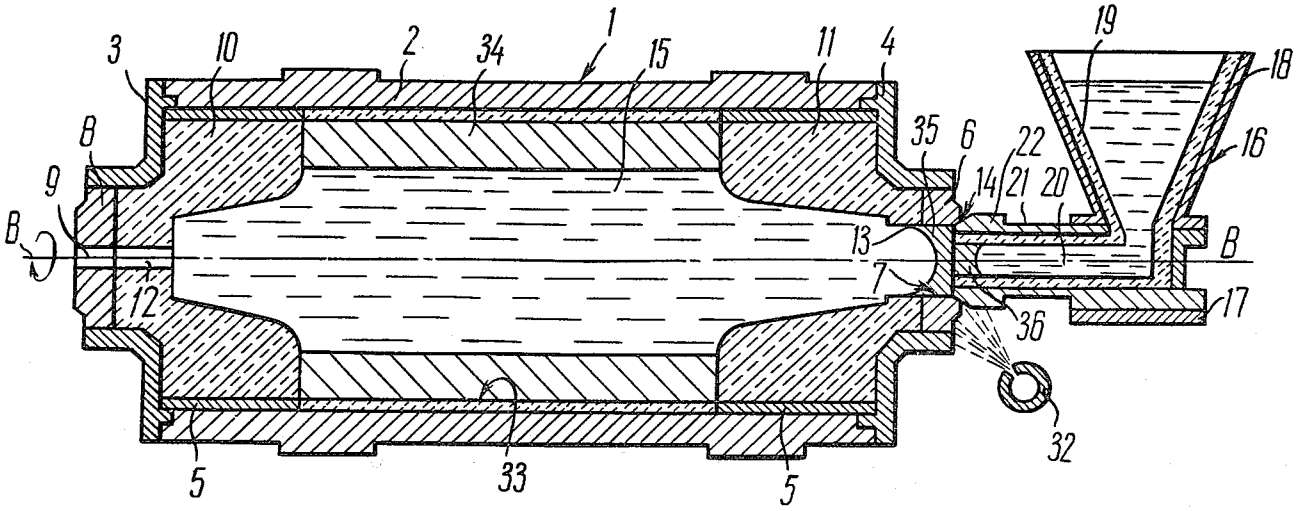
FIG. 1 shows the casting mould in a longitudinal section.

The installation comprises a horizontally disposed casting mould 1 (FIG. 1) with a cylindrical cast-iron housing 2 closed at both ends by steel end caps 3 and 4. Located inside housing 2 adjacent its ends are thin-walled steel bushings 5.

Mould 1 rests on rollers (not shown in the drawings) mounted on a basement (not shown), and is connected to a drive for rotating the mould about its longitudinal axis (the drive and its connection with the mould are not shown).

Available in the end cap 4 is a cast-iron insert 6 with an inlet hole 7 serving for pouring metal into the mould. In the end cap 3 there is provided a steel disk 8 with an exhaust hole 9 for letting out gas. The mould shown in FIG. 1 is intended for casting mill rolls. Since the roll has necks whose configuration is determined by a number of conditions, the length of mould 1 is taken with some allowance.

To obtain the required configuration of the roll necks, the end caps 3 and 4 are separated from the mould, the steel bushings 5 and neck patterns (not shown in the drawings) being then placed thereon, whereupon each of the chambers formed by one of the end caps 3 and 4, bushing 5, and the pattern, is filled with a fluid-glass moulding mixture. Thus, solid formations 10 and 11 are produced, which are then introduced into mould 1 together with the end caps 3 and 4, and the bushings 5. Provided in formations 10 and 11 are channels 12 and 13, respectively.

Figure 2:
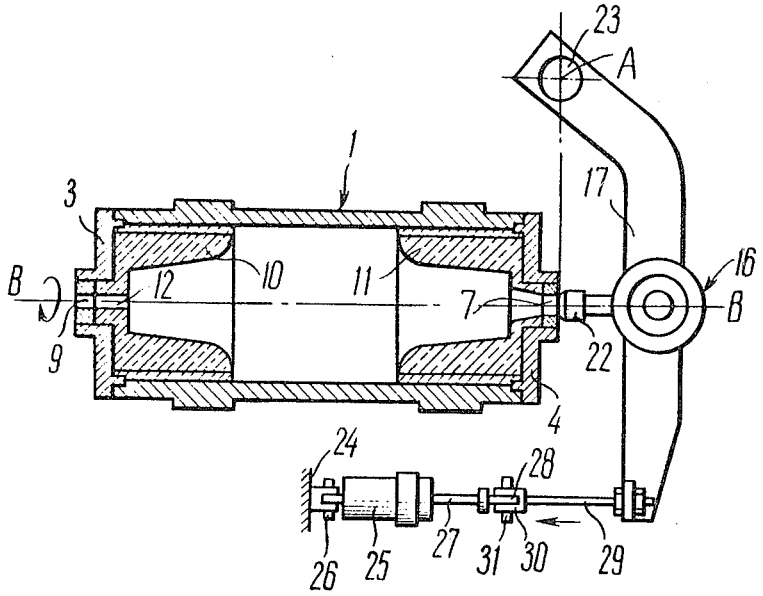
FIG. 2 shows the installation in a position when the ingot is being formed, cut-away plan view to a reduced scale.
Figure 3:
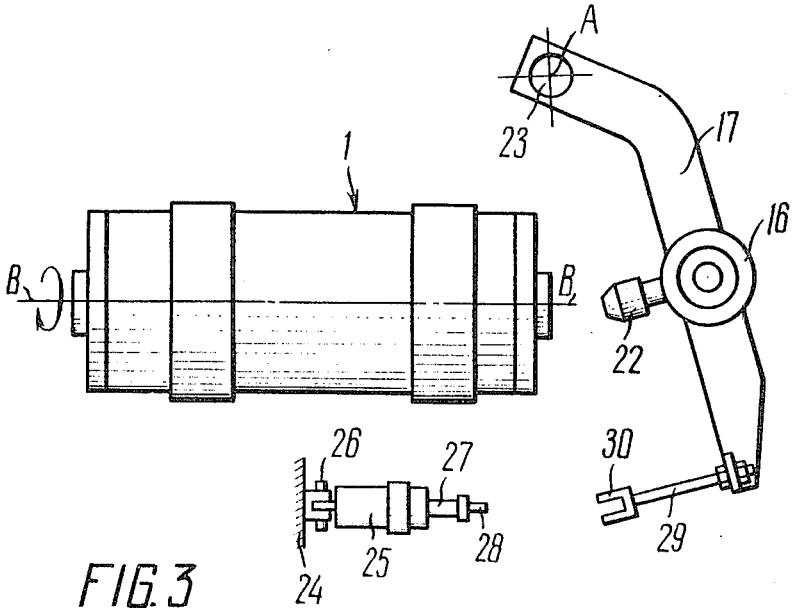
FIG. 3 shows the installation in a position when the ingot formation is completed, on a reduced scale.

Walls 14 of the inlet hole 7 in insert 6 are given a tapered shape. Metal 15 is poured into mould 1 through a runner means 16 (FIGS. 1–3) mounted on a pivoting base 17. The runner means comprises a steel bowl 18 lined with grog 19. Bowl 18 communicates with a channel 20 in a steel pipe 21 lined with grog as in bowl 18.

The outlet end 22 of the runner means 16 has a tapered shape congruent with the shape of the inlet hole 7 of mould 1. Base 17 is made to pivot in a horizontal plane. The axis AA (FIGS. 2, 3) of pivoting of base 17, which is also the axis of a vertical pivot 23 mounted on a fixed basement (not shown in the drawings), is situated on a perpendicular OA erected from a point O on the rotation axis BB of the casting mould 1, which point is located approximately in the middle of that section of the inlet hole 7 of the mould where the walls of the inlet hole contact the outlet end 22 of the runner means 16. The distance OA between point O and axis AA of pivoting of base 17 is taken sufficiently long, so that the outlet end 22 should move approximately along the rotation axis BB of the casting mould 1 at the time when it contacts the walls of the inlet hole 7.

The critical condition for preventing the outflow of metal from mould 1 in the process of metal pouring and solidification is a forced tight pressure of the outlet end 22 of runner means 16 against the walls 14 of the inlet hole 7 of mould 1. For this purpose mounted near the casting mould 1 on a fixed basement 24 by means of a hinge 26 with a horizontal swivel pin is a hydraulic power cylinder 25 whose piston rod 27 has an ear 28, while on the pivoting base 17 there is provided a stem 29 with a fork 30 intended for connection with ear 28 by a pin 31. Location of the runner means 16 on the pivoting base 17 combined with the connecting of the latter to the power cylinder 25 enables the outlet end 22 of the runner means 16 to be rapidly introduced into the inlet hole 7 of mould 1, and forced against the walls of said hole. Achieved as rapidly is the disconnection of base 17 from cylinder 25, and retraction of the runner means 16 from mould 1. Mounted near the zone of contact of the runner means 16 with mould 1 is a sprayer 32 (FIG. 1).

Before pouring metal, mould 1 is rotated about axis BB, and introduced into the mould is a refractory material 33 which by a thin layer covers the inner walls of the cast-iron housing 2 of mould 1. The outlet end 22 of the runner means 16 is introduced into the inlet hole 7 of mould 1 by pivoting base 17, and the base is connected to cylinder 25. Sprayer 32 is switched on, its water jets spraying over the cast iron insert 6 and the steel pipe 21.

Fluid is fed into cylinder 25 under pressure, so as to force, through base 17, the outlet end 22 against walls 14 of the inlet hole 7. In the fluid supply main (not shown), a non-return valve is mounted ahead of cylinder 25 to prevent spontaneous pressure drops in that chamber of the cylinder 25 which pulls the piston rod 27 into the cylinder.

First poured into mould 1 is metal 34 which forms the outer layer of the roll, and after its temperature reaches the required value, flux (not shown in the drawings) is poured in to create favorable conditions for a firm joint of the outer layer of the roll with its core. Then metal 15 is poured to form the roll core. Gases released during pouring are let out through the exhaust hole 9 provided in disk 8.

With the cooling of the cast-iron insert 6 a metal plug 35 is formed in the inlet hole 7 of mould 1, thus preventing the outflow of metal 15 located in the central zone of the casting mould.

Formed at the same time in the runner channel 20 is a plug 36 of solidified metal filling this channel. Plugs 35 and 36 prevent communication between the fluid metals in the mould and in the runner means 16.

Plug 35 rotates together with mould 1, while plug 36 is at rest.

We claim:

1. An installation for producing cylindrical-shaped bimetallic solid bodies, comprising: a casting mould adapted to rotate about a horizontal axis and having at one end an inlet hole with tapered walls in its outer portion serving to pour metal therethrough, and at the other end an exhaust hole to let out gas during metal pouring; a runner means with an outlet end whose shape is congruent with the shape of said tapered walls, said runner means being mounted on a base adapted to displace said outlet end of said runner means along said horizontal axis of rotation of said casting mould and to tightly press said outlet end of said runner means against said tapered walls of said inlet hole of said casting mould, said base, on which said runner means is mounted, is made to pivot in the horizontal plane, the axis of said base pivoting being intersected by a perpendicular erected from a point on the rotation axis of said casting mould, which point is located in the middle of that section of said inlet hole of said mould where said tapered walls of said inlet hole contact said outlet end of said runner means.

2. The installation as claimed in claim 1, further comprising: a hydraulic power cylinder mounted adjacent said casting mould on a fixed basement and an arrangement on said base carrying said runner means for connecting said base to said cylinder after said outlet end of said runner means enters said inlet hole of said casting mould, said cylinder thus tightly pressing said outlet end against said tapered walls of said inlet hole.

3. The installation as claimed in claim 1, further comprising a sprayer mounted adjacent the zone of contact of said outlet end of said runner means with said tapered walls of said inlet hole of said casting mould for cooling said zone by sprayed water.

* * * * *